United States Patent [19]

Wolcott, Jr.

[11] Patent Number: 4,522,260

[45] Date of Patent: Jun. 11, 1985

[54] METHOD FOR CREATING A ZONE OF INCREASED PERMEABILITY IN HYDROCARBON-CONTAINING SUBTERRANEAN FORMATION PENETRATED BY A PLURALITY OF WELLBORES

[75] Inventor: Herbert B. Wolcott, Jr., Plano, Tex.

[73] Assignee: Atlantic Richfield Company, Los Angeles, Calif.

[21] Appl. No.: 583,065

[22] Filed: Feb. 23, 1984

Related U.S. Application Data

[63] Continuation-in-part of Ser. No. 366,510, Apr. 8, 1982, Pat. No. 4,446,918.

[51] Int. Cl.[3] ..... E21B 43/24; E21B 43/247; E21B 43/30

[52] U.S. Cl. ..... 166/245; 166/50; 166/248; 166/259; 166/272; 166/299

[58] Field of Search ..... 166/50, 245, 259, 299, 166/248, 272; 299/2, 13; 48/DIG. 6

[56] References Cited

U.S. PATENT DOCUMENTS

| | | | |
|---|---|---|---|
| 3,017,168 | 1/1962 | Carr | 299/2 |
| 3,209,825 | 10/1965 | Alexander et al. | 166/245 |
| 3,565,173 | 2/1971 | Anderson | 166/299 |
| 3,659,652 | 5/1972 | Roberts | 166/299 |
| 3,734,180 | 5/1973 | Rhoades | 166/259 |
| 3,999,607 | 12/1976 | Pennington et al. | 166/259 |
| 4,022,279 | 5/1977 | Driver | 166/299 X |
| 4,026,356 | 5/1977 | Shuck | 166/259 |
| 4,109,964 | 8/1978 | Ridley | 166/259 X |
| 4,222,437 | 9/1980 | Sabol | 166/245 |
| 4,356,866 | 11/1982 | Savings | 166/50 X |
| 4,446,918 | 5/1984 | Wolcott, Jr. | 166/245 |

*Primary Examiner*—George A. Suchfield
*Attorney, Agent, or Firm*—F. Lindsey Scott

[57] ABSTRACT

A method for creating a zone of increased permeability in a subterranean hydrocarbon-containing formation penetrated by a plurality of wellbores by penetrating the formation with a first wellbore; positioning a plurality of other wellbores about the first wellbore with each of the other wellbores having at least one substantially horizontal borehole extending therefrom into the vicinity of the first wellbore; extending a plurality of substantially horizontal boreholes from the first wellbore into the vicinity of the other wellbores; positioning explosive charges in at least a portion of the boreholes and detonating the explosive charges to produce a rubblized zone between the first wellbore and the other wellbores.

13 Claims, 2 Drawing Figures

Figure 1:
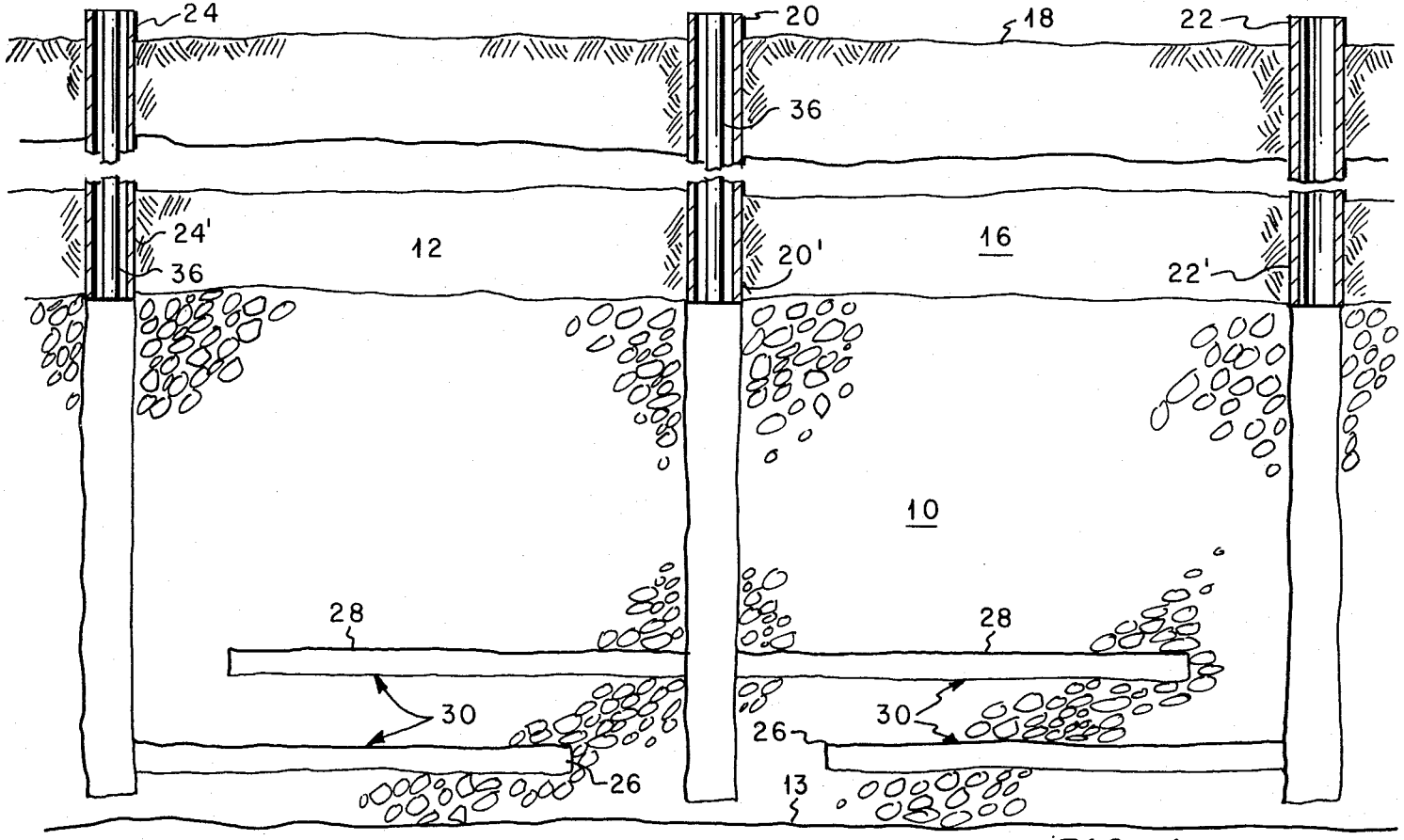

METHOD FOR CREATING A ZONE OF INCREASED PERMEABILITY IN HYDROCARBON-CONTAINING SUBTERRANEAN FORMATION PENETRATED BY A PLURALITY OF WELLBORES

This application is a continuation in part of my earlier filed U.S. patent application, Ser. No. 366,510, entitled "Method For Initiating Combustion In A Subterranean Carbonaceous Deposit" filed Apr. 8, 1982, now U.S. Pat. No. 4,446,918.

This invention relates to a method for creating a zone of increased permeability in a subterranean hydrocarbon-containing formation.

This invention further relates to an improvement in enhanced recovery methods for the recovery of hydrocarbons from hydrocarbon-containing formations which have poor drainage of hydrocarbons into wells penetrating such subterranean formations.

In recent years, there has been an increased interest in the recovery of hydrocarbons from formations which have previously been considered unsuitable for the production of hydrocarbon materials. Some such formations are tar sands, heavy oil-containing formations, oil shales and tight gas reservoirs. Such formations are known to contain substantial quantities of valuable hydrocarbon materials. However, these materials are recoverable from such formations only with considerable difficulty. In many instances, the hydrocarbon materials are highly viscous and do not flow readily from the formations. Various enhanced recovery methods have been used to reduce the viscosity of such materials by heating the hydrocarbons, mixing viscosity-reducing materials with the hydrocarbons, diluting the hydrocarbons with solvents and the like. Such methods are designed to reduce the viscosity of hydrocarbon materials so that they will flow from the hydrocarbon-containing formation into wellbores, cavities in the formation or the like for recovery by pumping to the surface of the like. Many such methods are known to those skilled in the art.

All such methods require that sufficient permeability be present in the formation so that the enhanced recovery methods can be practiced. In other words, contacting the heavy hydrocarbon materials by solvents, steam, hot water or the like requires that sufficient permeability be present in the formation so that these materials can be brought into contact with the hydrocarbon materials in the formation and so that the hydrocarbons can drain from the formation. Other methods such as electric heating and the like also require that the formation have sufficient permeability so that the hydrocarbon materials can flow to a zone where they can be collected and recovered.

Many of the formations which contain such heavy hydrocarbon materials have relatively low to almost no permeability in their natural state. As a result, it is very difficult to recover hydrocarbons from such formations using enhanced recovery methods. Various alternatives to the use of conventional enhanced recovery methods in such formations have been proposed such as oil mining, tunneling, explosive fracturing with nuclear devices, and the like. Many of these approaches are directed to attempts to create zones of permeability in which enhanced recovery processes can be practiced. A prime requisite of any such method for creating a zone of increased permeability in such formations is that it must be economical and reliable.

According to the present invention, zones of increased permeability are created between wellbores penetrating a hydrocarbon-containing subterranean formation by:

(a) penetrating the formation with a first wellbore;

(b) positioning a plurality of other wellbores about the first wellbore, each of the other wellbores having at least one substantially horizontal borehole extending therefrom into the vicinity of the first wellbore;

(c) extending a plurality of substantially horizontal boreholes from the first wellbore into the vicinity of the other wellbores (d) positioning explosive charges in at least a portion of the boreholes; and, (e) detonating the explosive charges to produce a rubblized zone between the first wellbore and the other wellbores A variety of well patterns can be used in the practice of the method of the present invention.

Figure 2:
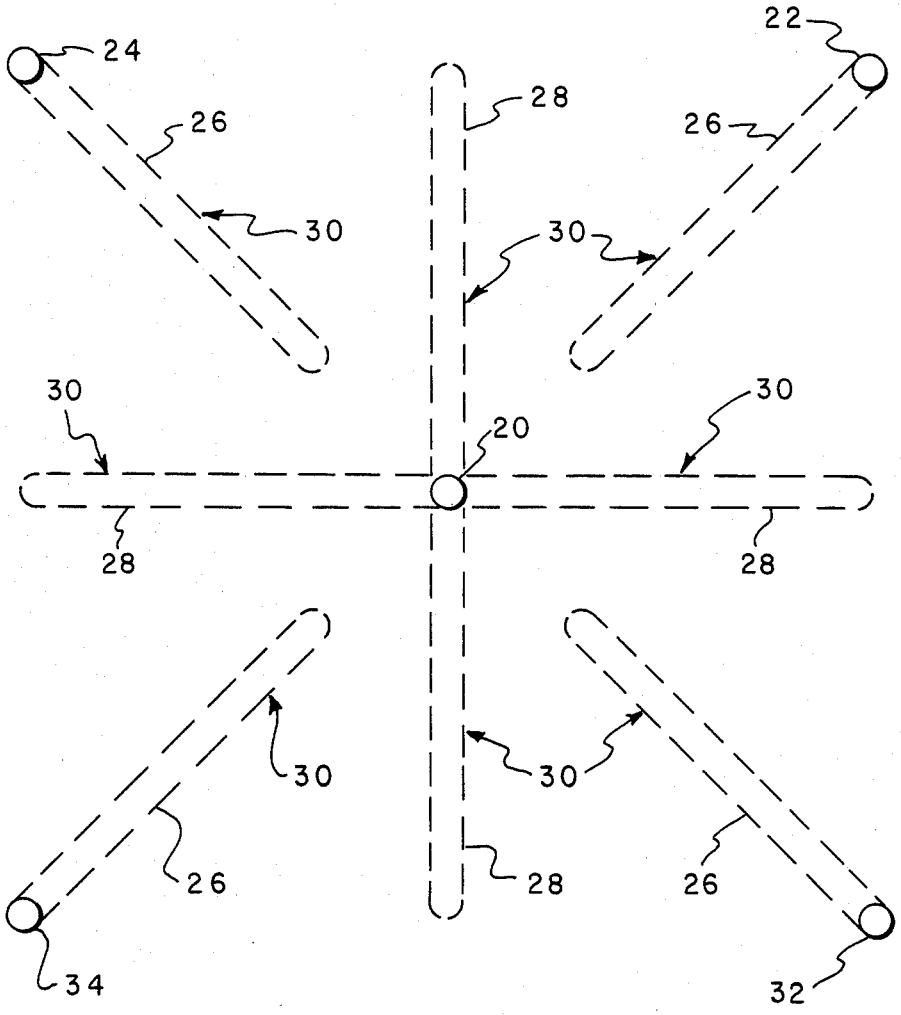

FIG. 1 is a schematic diagram of an embodiment of the process of the present invention wherein three wellbores are used; and, FIG. 2 is a top view of a five well pattern, indicating the positioning of the boreholes used in an embodiment of the method of the present invention.

In the discussion of the Figures, the same numbers will be used to refer to the same or similar components throughout.

In FIG. 1 a subterranean hydrocarbon-containing formation 10 is shown an overburden 16. Formation 10 is penetrated by a first wellbore 20, a second wellbore 22 and a third wellbore 24 from the surface 18. Wellbores 20, 22, and 24 as shown extend to near the bottom 13 of formation 10 and are cased with casings 20', 22', and 24', respectively, to the top 12 of formation 10. Boreholes 28 extend substantially horizontally outwardly from wellbore 20 into the vicinity of wellbores 22 and 24. Boreholes 26 extend substantially horizontally from wellbores 22 and 24 into the vicinity of wellbore 20. Explosives are conveniently positioned in either boreholes 26 or 28 at points indicated by arrows 30. Explosives need not be positioned in both boreholes 26 and 28 unless required, but it is desirable that the material between boreholes 26 and 28 be rubblized upon detonation of the explosives, so that a rubblized zone of increased permeability is positioned between wellbore 22 and wellbore 20 and wellbore 20 and wellbore 24.

FIG. 2 is a top view of a five well pattern including boreholes positioned for the practice of the present invention. Additional wellbores 32 and 34 are positioned as shown. Explosives may be positioned in any or all of the boreholes as required for the efficient rubblization of the zone between the boreholes. Suitable locations for the explosives are shown by arrows 30.

The drilling of boreholes 26 and 28 is readily accomplished by means known to those skilled in the art by drainhole drilling techniques using vertical whipstock settings so that the boreholes are drilled at a common level from each well or at least from a rear common level in each well. Desirably, boreholes 26 and 28 are substantially horizontal or in the event of formations which are not horizontal, generally parallel to the plane of the formation. By the use of explosives in boreholes 26 and 28, a zone of increased permeability is created between the wellbores by rubblizing portions of formation 10 between boreholes 26 and 28. The void space required in a rubblized zone for increased permeability is available in the form of the space comprising boreholes 26 and 28. The space comprising the boreholes permits the formation of a rubble zone which is not compacted and which permits the flow of liquid or gaseous materials freely through the rubblized zone.

The explosives used are desirably conventional explosives which may be positioned in boreholes 26 and 28 by a variety of techniques known to those skilled in the art. For instance, the explosives used could be conventional explosives packed into a flexible plastic pipe which is then inserted into a borehole to position the explosive at the desired location.

The recovery of hydrocarbon materials from such formations may then be accomplished by a variety of enhanced recovery methods. These methods comprise techniques such as electric heating, steam injection, hot water injection, in-situ combustion, solvent extraction, and the like.

In the use of electric heating, an electric current is used to heat at least a portion of the formation so that the hydrocarbons contained in the formation have a reduced viscosity and are more readily recovered from the formation. In the use of steam, steam or superheated steam may be injected alone or in combination with other materials to reduce the viscosity of hydrocarbons contained in a subterranean formation and in some instances as a driving fluid to cause the hydrocarbons to move toward a recovery well. Similarly, hot water has been used to enhance the recovery of hydrocarbons from subterranean formations. In-situ combustion has been used to enhance the recovery of hydrocarbons from such formations but unlike the use of in-situ combustion for the recovery of gasification products from coal and carbonaceous deposits, such in-situ combustion processes are generally designed to result in the use of combustion gases produced in-situ to reduce the viscosity of the remaining hydrocarbon materials in the formation to facilitate the recovery of such hydrocarbon materials from the formation. Gases from such in-situ combustion generally contain carbon oxides and may contain minor amounts of hydrogen and light hydrocarbon materials. Such gases are known to reduce the viscosity of heavy hydrocarbons and the thermal energy introduced into the formation by the in-situ combustion also tends to result in a reduction in the viscosity of such hydrocarbons, thus facilitating their recovery from the formation. Solvent extraction generally involves the injection of a solvent for the heavy hydrocarbons so that the heavy hydrocarbons are recovered as a solution of the solvent and heavy hydrocarbons.

Various such enhanced recovery methods are known to those skilled in the art and need not be discussed further. Most such methods require that the formation from which the hydrocarbons are to be recovered have sufficient permeability so that the enhanced recovery method materials may pass through or into the formation or sufficient permeability so that the hydrocarbon products may drain from the formation into a recovery well or the like. The practice of these methods is improved by the creation of a zone of increased permeability between wellbores penetrating such subterranean hydrocarbon containing formations. According to the method of the present invention, such a zone of improved permeability is readily created. Clearly a variety of well patterns could be used. Similarly, it may not be necessary in all instances that explosives be positioned in all boreholes. In other words, in some instances, if the formation is sufficiently friable and otherwise suitable, a zone of increased permeability may be created between the wellbore in a given pattern without the use of explosives in all boreholes. It may be desirable in some instances that additional boreholes be drilled to create additional volume to result in increased permeability in the rubblized zone, i.e. the zone of increased permeability.

Various advantages are achieved by the practice of the method of the present invention as follows:

(a) a rubble zone (zone of increased permeability) of limited vertical extent and wide areal extent can be created;

(b) expansion room for the formation solids is provided by the boreholes and the porosity of the rubblized zone should be nearly equal to the volume of the boreholes;

(c) substantial quantities of explosives can conveniently be positioned in the formation in the boreholes;

(d) the expansion room provided by the boreholes will tend to reduce compaction of formation solids and loss of any natural permeability which might be present during the enhanced recovery processes;

(e) the vertical height and areal extent of the rubblized zone can be controlled which is an important consideration in situations where the formation might be damaged by breaking into gas caps or water zones;

(f) a rubblized zone of wide areal extent could provide sufficient drainage area for the successful production of right gas reservoirs and heavy oil reservoirs;

(g) all work is done from the surface, i.e., no mining is required;

(h) existing wells can be used; and (i) conventional explosives can be used.

The practice of enhanced recovery methods is considered to be to known to those skilled in the art and it is not considered necessary to discuss the use of such methods in detail. In general, in such methods, a fluid which may or may not be heated is injected into a subterreanean formation to improve the recovery of hydrocarbon materials from the formation. Tubing 36 has been shown in wellbores 20 and 24 to indicate that tubing can be used in the wellbores for the recovery of hydrocarbons from formation 10. The tubing in many instances will extend to near the bottom of the wellbore as will the casing in the wellbore, i.e., casings 20', 22', 24' as shown in wells 20, 22, 24, respectively. In many instances, the tubing and/or casing may be positioned to a desired depth after the formation of the rubblized zone and the like. The specific method by which the casing is positioned to a desired depth and by which the tubing is positioned to a desired depth are highly dependent upon the particular type of enchanced recovery chosen and will not be discussed in detail. Clearly, if necessary, wells 20, 22, and 24 could be re-drilled to a desired depth through a rubblized zone after formation of the rubblized zone. Such techniques are well known to those skilled in the art and need not be discussed in detail.

Having thus described the present invention by reference to certain of its preferred embodiments, it is noted that the embodiments described are illustrative rather than limiting in nature and that many variations and modifications are possible within the scope of the present invention. Many such variations and modifications may be considered obvious and desirable by those skilled in the art upon a review of the foregoing description of preferred embodiments.

Having thus described the invention, I claim:

1. A method for creating a zone of increased permeability in a subterranean hydrocarbon-containing formation selected from the group consisting of tar sands, heavy oil-containing formations, oil shales and tight gas reservoirs penetrated by a plurality of wellbores, said method consisting essentially of:

(a) penetrating said formation with a first wellbore;

(b) positioning a plurality of other wellbores about said first wellbore, each of said other wellbores having at least one substantially horizontal borehole extending therefrom into the vicinity of said first wellbore;

(c) extending a plurality of substantially horizontal boreholes from said first wellbore into the vicinity of said other wellbores (d) positioning explosive charges in at least a portion of said boreholes; and, (e) detonating the explosive charges to produce a rubblized zone between said first wellbore and said other wellbores.

2. The method of claim 1 wherein said formation is a heavy oil-containing formation.

3. The method of claim 1 wherein said formation is an oil shale formation.

4. The method of claim 1 wherein said formation is a tight gas reservoir.

5. The method of claim 1 wherein said formation is a tar sand formation.

6. The method of claim 1 wherein said hydrocarbons are recovered from said formation by an enhanced recovery method.

7. The method of claim 6 wherein said hydrocarbons are recovered from said formation by a recovery method selected from the group consisting of electric heating, steam injection, hot water injection, in-situ combustion and solvent extraction.

8. In a method for producing hydrocarbons from a hydrocarbon-containing subterranean formation selected from the group consisting of tar sands, heavy oil-containing formations, oil shales and tight gas reservoirs penetrated by a plurality of wellbores by an enhanced recovery process, an improvement comprising creating a zone of increased permeability in said formation by:

(a) penetrating said formation with a first wellbore;

(b) positioning a plurality of other wellbores about said first wellbore, each of said other wellbores having at least one substantially horizontal borehole extending therefrom into the vicinity of said first wellbore;

(c) extending a plurality of substantially horizontal boreholes from said first wellbore into the vicinity of said other wellbores (d) positioning explosive charges in at least a portion of said boreholes; and, (e) detonating the explosive charges to produce a rubblized zone between said first wellbore and said other wellbores.

9. The method of claim 8 wherein said formation is a heavy oil-containing formation.

10. The method of claim 8 wherein said formation is an oil shale formation.

11. The method of claim 8 wherein said formation is a tight gas reservoir.

12. The method of claim 8 wherein said formation is a tar sand formation.

13. The method of claim 8 wherein said enhanced recovery method is selected from the group consisting of electric heating, steam injection, hot water injection, in-situ combustion and solvent extraction.

* * * * *